US007069253B2

(12) United States Patent
Leon

(10) Patent No.: US 7,069,253 B2
(45) Date of Patent: Jun. 27, 2006

(54) TECHNIQUES FOR TRACKING MAILPIECES AND ACCOUNTING FOR POSTAGE PAYMENT

(75) Inventor: J. P. Leon, Tucson, AZ (US)

(73) Assignee: Neopost Inc., Hayward, CA (US)

( * ) Notice: Subject to any disclaimer, the term of this patent is extended or adjusted under 35 U.S.C. 154(b) by 95 days.

(21) Appl. No.: 10/259,279

(22) Filed: Sep. 26, 2002

(65) Prior Publication Data

US 2004/0083189 A1 Apr. 29, 2004

(51) Int. Cl.
*G07B 17/00* (2006.01)

(52) U.S. Cl. ..... 705/408; 705/410

(58) Field of Classification Search ..... 705/22, 705/28, 401, 408, 410
See application file for complete search history.

(56) References Cited

U.S. PATENT DOCUMENTS 2,964,232 A * 12/1960 Schuessler ..... 229/303
3,221,980 A * 12/1965 Mercur ..... 229/71
4,447,890 A 5/1984 Duwel et al.
4,657,697 A 4/1987 Chiang
4,725,718 A 2/1988 Sansone et al.
4,743,747 A 5/1988 Fougere et al.
4,757,537 A 7/1988 Edelmann et al.
4,775,246 A 10/1988 Edelmann et al.
4,812,994 A 3/1989 Taylor et al.
4,813,912 A 3/1989 Chickneas et al.
4,831,555 A 5/1989 Sansone et al.
4,853,865 A 8/1989 Sansone et al.
4,853,961 A 8/1989 Pastor
4,949,381 A 8/1990 Pastor
5,142,577 A 8/1992 Pastor
5,181,245 A 1/1993 Jones
5,231,668 A 7/1993 Kravitz
5,280,531 A 1/1994 Hunter
5,319,562 A 6/1994 Whitehouse
5,369,258 A 11/1994 Sansone et al.
5,375,172 A * 12/1994 Chrosny ..... 380/51
5,377,268 A 12/1994 Hunter (Continued)

FOREIGN PATENT DOCUMENTS

EP 0732673 A2 * 9/1996

(Continued)

OTHER PUBLICATIONS

PRNewswire: "TanData™ Corporation Announces Progistics CS™ , Their Newest, Internet-Enabled Shipping and Rating Software", Tulsa, Okla. Jul. 21, 1997.*

(Continued)

*Primary Examiner*—Thomas A. Dixon
(74) *Attorney, Agent, or Firm*—Townsend and Townsend and Crew LLP

(57) ABSTRACT

A method of preparing a mailpiece includes applying a mailpiece identification (MI) code that uniquely identifies the mailpiece, and applying a destination code to the mailpiece signifying at least part of an address. Tracking and accounting for such a mailpiece includes: at an postal service mail processing (MP) site, obtaining the MI code and the destination code, and sending a mailpiece message including at least the MI code to a postage vendor (PV) site; and at the PV site, storing information from the mailpiece message, debiting an account of the mailer for postage, crediting an account of a postal service for postage, and when the mailpiece message indicates that the mailpiece has arrived at its destination, retiring the MI code as no longer available for use on a mailpiece (at least for some predetermined time).

23 Claims, 8 Drawing Sheets

U.S. PATENT DOCUMENTS

| | | | | | |
|---|---|---|---|---|---|
| 5,420,403 | A | * | 5/1995 | Allum et al. | 235/375 |
| 5,448,641 | A | | 9/1995 | Pintsov et al. | |
| 5,457,636 | A | | 10/1995 | Sansone et al. | |
| 5,602,382 | A | * | 2/1997 | Ulvr et al. | 235/462.02 |
| 5,612,889 | A | * | 3/1997 | Pintsov et al. | 700/226 |
| 5,625,694 | A | | 4/1997 | Lee et al. | |
| 5,627,517 | A | * | 5/1997 | Theimer et al. | 340/572.1 |
| 5,638,442 | A | | 6/1997 | Gargiulo et al. | |
| 5,666,421 | A | | 9/1997 | Pastor et al. | |
| 5,688,056 | A | | 11/1997 | Peyret | |
| 5,715,164 | A | | 2/1998 | Liechti et al. | |
| 5,737,729 | A | | 4/1998 | Denman | |
| 5,742,683 | A | | 4/1998 | Lee et al. | |
| 5,781,438 | A | | 7/1998 | Lee et al. | |
| 5,793,867 | A | | 8/1998 | Cordery et al. | |
| 5,822,738 | A | | 10/1998 | Shah et al. | |
| 5,822,739 | A | | 10/1998 | Kara | |
| 5,826,247 | A | * | 10/1998 | Pintsov et al. | 705/404 |
| 5,826,267 | A | | 10/1998 | McMillan | |
| 5,848,401 | A | | 12/1998 | Goldberg et al. | |
| 5,909,373 | A | | 6/1999 | Sansone et al. | |
| 5,920,850 | A | | 7/1999 | Hunter et al. | |
| 5,963,928 | A | | 10/1999 | Lee | |
| 5,970,150 | A | | 10/1999 | Sansone | |
| 5,978,781 | A | * | 11/1999 | Sansone | 705/408 |
| 6,010,156 | A | | 1/2000 | Block | |
| 6,061,670 | A | * | 5/2000 | Brand | 705/404 |
| 6,064,994 | A | * | 5/2000 | Kubatzki et al. | 705/410 |
| 6,085,195 | A | | 7/2000 | Hoyt et al. | |
| 6,141,684 | A | | 10/2000 | McDonald et al. | |
| 6,208,980 | B1 | | 3/2001 | Kara | |
| 6,249,777 | B1 | | 6/2001 | Kara et al. | |
| 6,262,717 | B1 | | 7/2001 | Donohue et al. | |
| 6,296,404 | B1 | | 10/2001 | Pierce et al. | |
| 6,505,179 | B1 | | 1/2003 | Kara | |
| 6,523,014 | B1 | * | 2/2003 | Pauschinger | 705/410 |
| 6,526,391 | B1 | | 2/2003 | Cordery et al. | |
| 6,527,178 | B1 | * | 3/2003 | Gordon et al. | 235/385 |
| 6,557,755 | B1 | * | 5/2003 | Pickering et al. | 235/376 |
| 6,594,374 | B1 | | 7/2003 | Beckstrom et al. | |
| 6,616,189 | B1 | * | 9/2003 | Raming | 283/81 |
| 6,697,500 | B1 | * | 2/2004 | Woolston et al. | 382/101 |
| 6,772,130 | B1 | * | 8/2004 | Karbowski et al. | 705/26 |
| 2002/0152174 | A1 | * | 10/2002 | Woods et al. | 705/60 |
| 2002/0193225 | A1 | * | 12/2002 | Raming | 493/375 |
| 2003/0225711 | A1 | * | 12/2003 | Paping | 705/404 |
| 2004/0083233 | A1 | * | 4/2004 | Willoughby | 707/104.1 |
| 2005/0104716 | A1 | * | 5/2005 | Simms et al. | 340/5.73 |

FOREIGN PATENT DOCUMENTS

| | | | | |
|---|---|---|---|---|
| EP | 825 565 | A2 | | 2/1998 |
| EP | 845 762 | A2 | | 6/1998 |
| EP | 1022688 | A2 | | 7/2002 |
| GB | 1 536 403 | A | | 12/1978 |
| JP | 04-291453 | | * | 10/1992 |
| WO | WO 97/46957 | A1 | | 12/1997 |
| WO | WO 98/13790 | A1 | | 4/1998 |
| WO | WO 98/20461 | A2 | | 5/1998 |
| WO | WO 98/48373 | | * | 10/1998 |
| WO | WO 98/57303 | A1 | * | 12/1998 |
| WO | WO 00/49580 | A1 | | 8/2000 |
| WO | WO 02/37736 | A2 | | 5/2002 |

OTHER PUBLICATIONS

"Information-Based Indicia Program (IBIP), Performance Criteria for Information-Based Indicia and Security Architecture for Closed IBI Postage Metering Systems (PCIBI-C)" Jan. 12, 1999, United States Postal Service, dated Jan. 12, 1999.

"Information Based Indicia Program(IBIP) Indicium Specification," United States Postal Service, dated Jun. 13, 1996.

Information Based Indicia Program Postal Security Device Specification, United States Postal Service, dated Jun. 13, 1996.

"Information Based Indicia Program Host System Specification [Draft]," United States Postal Service, dated Oct. 9, 1996.

"Information-Based Indicia Program (IBIP), Performance Criteria for Information-Based Indicia and Security Architecture for IBI Postage Metering Systems (PCIBISAIBIPMS)," United States Postal Service, dated Aug. 19, 1998.

United States Postal Service, "Performance Criteria For Information-Based Indicia And Security Architecture For Open IBI Postage Evidencing Systems," Information Based Indicia Program (IBIP), Jun. 25, 1999 XP-002161216.

Barker-Benfield, "First Union Offers Online Transactions," *Florida Times-Union*, Jan. 28, 1994.

FIBS PUB 140-1, Federal Information Processing Standards Publication, (Jan. 11, 1994) Security Requirements for Cryptographic Modules, U.S. Department of Commerce, Ronald H. Brown, Secretary, National Institute of Standards and Technology; pp.1-51.

* cited by examiner

| Location of MPS Sending Message, Location of PVS, and Other Header Information | | | | |
|---|---|---|---|---|
| MIG Code | MI Code Trailer | Postage | Destination | Time MI Code Scanned |
| ••• | ••• | ••• | ••• | ••• |
| 046N9745 | 0003456789 | 0.37 | 94301 | 09/02/02 15:10:33 |
| 093N9721 | 5786468719 | 13.6. | 07632 | 09/02/02 15:12:07 |
| 053N9763 | 2754167416 | 3.85 | 32501 | 09/02/02 15:20:05 |
| ••• | ••• | ••• | ••• | ••• |

| MIG Code and Other Header Information | | | |
|---|---|---|---|
| MI Code Trailer | Postage | Destination | Time MI Code Generated |
| ••• | ••• | ••• | ••• |
| 0003456789 | 0.37 | 94301 | 09/01/02 13:00:02 |
| 0003456790 | 2.45. | 80301. | 09/01/02 13:00:03 |
| 0003456791 | 6.75 | 78746 | 09/01/02 13:00:04 |
| ••• | ••• | ••• | ••• |

TECHNIQUES FOR TRACKING MAILPIECES AND ACCOUNTING FOR POSTAGE PAYMENT

CROSS-REFERENCE TO RELATED APPLICATIONS

The following commonly owned U.S. patent applications are hereby incorporated by reference in their entirety (including all attached documents and appendices) for all purposes:

- application Ser. No. 10/109,539, filed Mar. 26, 2002, titled "Techniques for Dispensing Postage Using a Communications Network" (J. P. Leon);
- application Ser. No. 09/902,480, filed Jul. 9, 2001, titled "Method and System for Providing Stamps by Kiosk" (James D. L. Martin, et. al.), now abandoned;
- application Ser. No. 09/708,971, filed Nov. 7, 2000, titled "Providing Stamps on Secure Paper Using a Communications Network," (J. P. Leon, et. al.), now abandoned; and
- application Ser. No. 09/708,883, filed Nov. 7, 2000, titled "Techniques for Dispensing Postage Using a Communication Network," (L. Carlton Brown, Jr., et. al.).

The following two commonly owned U.S. patent applications (including this one) are being filed concurrently, and are hereby incorporated by reference in their entirety for all purposes:

- application Ser. No. 10/259,279, filed Sep. 26, 2002, titled "Techniques for Tracking Mailpieces and Accounting for Postage Payment" (J. P. Leon); and
- application Ser. No. 10/259,269, filed Jul. 9, 2001, titled "Method for Tracking and Accounting for Reply Mailpieces and Mailpiece Supporting the Method" (J. P. Leon).

BACKGROUND OF THE INVENTION

This application relates generally to postage value accounting and metering, and more specifically to mailpiece tracking for informational and accounting purposes.

Existing USPS Mail Sorting and Tracking Techniques

The United States Postal service (USPS) has for many years used what is referred to as a POSTNET barcode for the purpose of automatically sorting mailpieces. The POSTNET barcode provides a machine-readable version of the mailpiece's ZIP code. To the extent that a mailpiece that enters the mail stream does not already have a POSTNET barcode, the USPS prints one on the mailpiece to facilitate further handling.

The USPS recently introduced Confirm®, a mail tracking service that provides electronic information to USPS mailers about their first-class, standard letter-size, flat mail, and periodicals. The Confirm® service uses, in addition to the POSTNET barcode, an additional barcode referred to as the PLANET™ code to track the mailer's mailpiece. The mailpiece would also include addressee information and a postage indicium, which might be a conventional meter imprint or a preprinted indicium such as those used for bulk mailings.

As the mailpiece progresses through to its destination, the mailpiece is scanned at the different USPS processing facilities through which it passes. These scans are sent to a centralized network service, which collects the scan data and packages it for use by the mailer. These package files are then electronically transferred from the centralized network and are available to the mailer in two ways. The mailer may view this data either by accessing the PLANET™ codes website or by having the files sent electronically. A 61-page Confirm® Customer Service Guide can be downloaded from the PLANET™ codes website.

The Confirm® service offers the customer two advance delivery information services, referred to as Destination Confirm® and Origin Confirm®. The Destination Confirm® service tracks outgoing mailpieces, such as solicitations, credit cards, and statements, providing mailers with information about when their mail is about to be delivered. This advanced notification enables mailers to synchronize telemarketing activities, track important documents and enclosures, and identify trends that help achieve delivery within specified delivery windows.

The Origin Confirm® service tracks incoming reply mailpieces such as payments, orders, and other responses. Mailers receive advance notification that reply pieces are in the mail stream, allowing them to process payments and manage cash flow more efficiently, evaluate the success of campaigns in near real-time, gain fulfillment operation efficiencies, and reduce costs associated with dunning notices.

Mail Fraud Issues

While the term mail fraud is usually used in the sense of criminals using the mails to defraud individuals and companies in connection with fraudulent transactions, a different and very serious concern of postal services worldwide is fraud on the postal service itself (postal services are alternatively referred to as postal authorities). Simply put, postal fraud in the current context means sending mail without paying for the postage. Unscrupulous mailers can manipulate postage meters to print indicia that are not accounted for, and most postage meter indicia can be duplicated (forged) by a determined criminal.

Another form of mail fraud involves under-reporting bulk mail. The term "bulk mail" refers to quantities of mail prepared for mailing at reduced postage rates, and includes discounted First-Class Mail and advertising mail (called "Standard Mail" by the USPS). With bulk mail, mailpieces bear a pre-printed indicium with a permit number, and the mailer provides the USPS a report or manifest regarding the number of mailpieces mailed. In order to qualify for the discounted rate, all the mailpieces need to be the same (except for the address), and the mailpieces need to be pre-sorted. While the USPS samples bulk mail deposits to verify the accuracy of the accompanying manifests, the USPS essentially relies on the honesty of the mailers. While the postal services do not publish statistics regarding postal fraud of the various types, it is estimated that annual lost revenues to the USPS run in the millions or tens of millions of dollars, or possibly more.

The USPS's Information-Based Indicia Program (IBIP)

The USPS has initiated a switch from mechanical meters, which store postage value in mechanical registers, to electronic meters, which are harder to tamper with. The vast majority of meters in service, including most electronic meters, use an impact printer, which makes indicia relatively easy to forge. In 1996, the United States Postal service (USPS) promulgated initial draft specifications for its Information-Based Indicia Program (IBIP). IBIP contemplates postal indicia printed by conventional printers (e.g., thermal, inkjet, or laser). An indicium refers to the imprinted designation or a postage mark used on mailpieces denoting evidence of postage payment, and includes human-readable and machine-readable portions. The machine-readable portion was initially specified to be a two-dimensional barcode symbology known as PDF417, but implementations using Data Matrix symbology have been deployed. The indicium content is specified to include a digital signature for security reasons (to preclude forgery).

There are separate specifications for open and closed systems. The specifications have been updated over the last few years; the recent specifications for open and closed systems are:

Information-Based Indicia Program (IBIP) Performance Criteria for Information-Based Indicia and Security Architecture for Open IBI Postage Evidencing Systems (PCIBI-O)(Draft Feb. 23, 2000), and Information-Based Indicia Program (IBIP) Performance Criteria for Information-Based Indicia and Security Architecture for Closed IBI Postage Metering Systems (PCIBI-C)(Draft Jan. 12, 1999).

These specifications are herein incorporated by reference in their entirety for all purposes.

An open system is defined as a general purpose computer used for printing information-based indicia, but not dedicated to the printing of those indicia. A closed system is defined as a system whose basic components are dedicated to the production of information-based indicia and related functions, that is, a device dedicated to creating indicia similar to an existing, traditional postage meter. A closed system may be a proprietary device used alone or in conjunction with other closely related, specialized equipment, and includes the indicium print mechanism.

IBIP specifies, for open and closed systems, a postal security device (PSD) that manages the secure postage registers and performs the cryptographic operations of creating and verifying digital signatures. This is a tamper-evident hardware component at the user site. In the case of an open system, it is attached to the host personal computer, while in a closed system, it is typically located within the same secure housing as the print mechanism. The closed system meter may be a standalone device or may be operated in communication with a host computer. In order to eliminate the need for secure hardware at the user site, there have been a number of systems where the PSD functions are performed at a server, and the user computer communicates with the server to download digitally signed indicium messages that can be formatted into IBIP-compliant indicia.

An indicium complying generally with the IBIP specifications is validated by verifying the digital signature that is included as part of the indicium. This is done by scanning the machine-readable portion of the indicium, obtaining the public key certificate number from the indicium, obtaining the public key corresponding to the certificate number, using the public key and the other data elements in the indicium to verify the digital signature using the algorithm that is used by the particular digital signature technique (e.g., DSA, RSA, ECDSA).

IBIP requires additional infrastructure for scanning mailpieces to verify the indicia, and to date only a small fraction of mailpieces bear IBIP-like indicia.

SUMMARY OF THE INVENTION

The present invention provides mailpiece tracking and accounting techniques that provide a high degree of assurance that when the postal service handles a mailpiece that is prepared in accordance with the invention, the postal service gets paid for handling that mailpiece.

In one aspect of the invention, each mailpiece receives a unique mailpiece identification (MI) code, which is generated under the control and authority of a postage vendor (PV) prior to the mailpiece being introduced into the mail stream. These MI codes are detected at postal service mail processing (MP) sites and sent in mailpiece messages to a postal vendor (PV) site. The PV credits a postal service account to pay for the postage before the mailpiece reaches its destination and debits a mailer account (debiting, in whole or part, could possibly have occurred before the mailpiece entered the mail stream). By arrangement among the postal service, the PV, and the mailer, the amount credited to the postal service account may be different from (normally less than) the amount charged against the mailer's account.

In another aspect of the invention, a method of preparing a mailpiece includes applying (typically by printing) a mailpiece identification (MI) code that uniquely identifies the mailpiece, and applying a destination code to the mailpiece signifying at least part of an address. The destination code can be applied at a mailer site or by the postal service after receipt of the mailpiece; the MI code is applied at the mailer site.

In another aspect of the invention, a method of tracking and accounting for such a mailpiece includes: at an MP site, obtaining the MI code and the destination code, and sending a mailpiece message including at least the MI code to a PV site; and at the PV site, storing information from the mailpiece message, debiting an account of the mailer for postage, crediting an account of a postal service for postage (possibly by a different amount), and when the mailpiece message indicates that the mailpiece has arrived at its destination, designating the MI code as a retired MI code. In this context, "retired" means that the MI code is no longer available for use on a mailpiece (at least for some predetermined time). Furthermore, reference to sending a mailpiece message is intended to cover various techniques such as batching the information for a plurality of mailpieces before sending the information to the PV site.

The MI code uniquely identifies the mailpiece and is for use in tracking and accounting for postage of the mailpiece. The destination code is for use in automated sorting of the mailpiece. The mailpiece passes through one or more mail processing sites, each of which extracts the MI code and sends a mailpiece message to the PV. The mailpiece message includes the MI code, a current location, and the destination of the mailpiece. The PV stores information from the mailpiece messages, credits an account of the postal service, and makes stored information regarding the current location of the mailpiece available in response to queries specifying the MI code. This is typically managed as a database. The stored information is also available to queries from the mailer to allow the mailer to obtain information (e.g., the MI codes) for those mailpieces for which the mailer's account has been debited.

A further understanding of the nature and advantages of the present invention may be realized by reference to the remaining portions of the specification and the drawings.

DESCRIPTION OF SPECIFIC EMBODIMENTS

Introduction and Terminology

Figure 1:
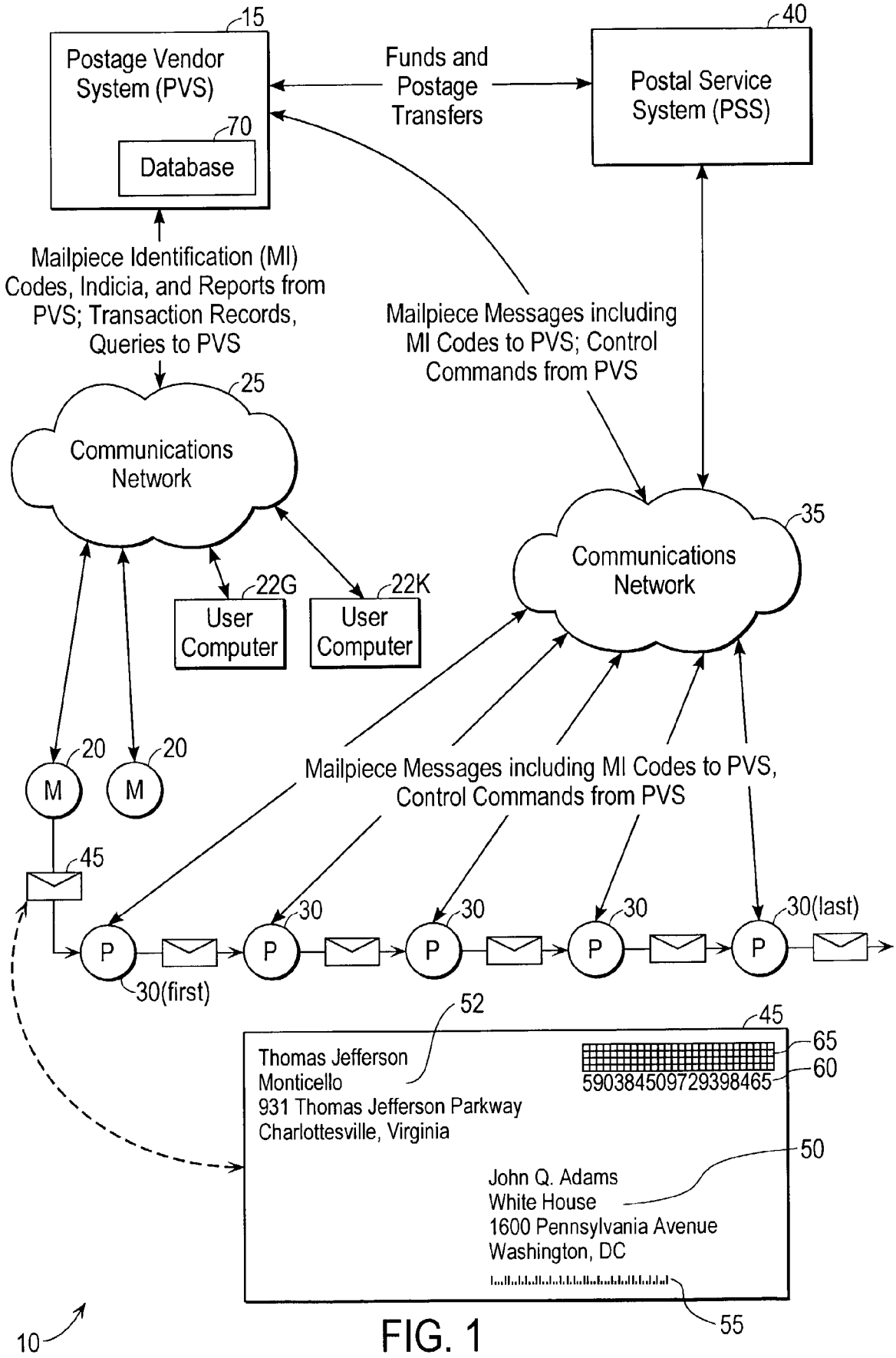
FIG. 1 is a block diagram of a mailpiece franking, tracking, and accounting system in an embodiment of the present invention.

As summarized above, the present invention relates to mailpiece tracking and accounting using mailpiece identification (MI) codes that are applied to the mailpieces. The invention in its various aspects includes methods, systems, and mailpiece components. The participants in certain transactions include a mailer, a recipient, a postage vendor (PV), and a postal service. The application uses a number of terms and expressions, which unless otherwise noted, are intended to be broadly interpreted. To this end, a number of the expressions are addressed below.

The term "debiting a mailer account" is intended to cover any way of charging a mailer, including debiting a prepaid account, billing the mailer, and charging the mailer's credit card. Similarly, "crediting a postal service account" is intended to cover any way of paying a postal service, including actually transferring funds and merely crediting an account. The mechanics by which a PV charges its customers and transfers funds to a postal service are well established and will not be discussed further. Additionally, with respect to references to debiting a mailer account for postage and crediting a postal service account for postage, it should be understood that the amounts of the debit and credit may be different.

The term "applying" a code or other information to a mailpiece or mailpiece component is intended to cover any method of causing the mailpiece to bear the code (e.g., printing, engraving), including applying the code to a label that is subsequently fastened to the mailpiece. The code may be in human-readable or machine-readable form, although most embodiments will apply at least a machine-readable format.

The term "mailer" is intended to cover the entity on whose behalf mailpieces are introduced into the mail stream, and in some contexts may include an entity that participates in preparing the mailpieces or portions of the mailpieces prior to the mailpieces being introduced into the mail stream. For example, a "mailer site" would cover an outside printing plant that prepares bills and mails them on behalf of a utility company, which is the entity on behalf of which the bills are mailed.

The terms "issue" and "generate" are sometimes used interchangeably in connection with the creation and use of MI codes, but generating the code and releasing it to a mailer can be separate activities. Where the PV generates an MI code, there is no general requirement that the MI code be immediately issued to a mailer upon generation by the PV, nor is there any general requirement that the MI code be applied to a mailpiece after it is generated. For example, a PV may generate a large number of MI codes, issue a batch to a mailer, who then applies them to mailpieces at later times. In other situations, MI codes are generated by the mailer and each code is applied to mailpieces essentially immediately thereafter.

The term "site" as used in connection with the various participants in transactions is intended to cover any location or set of multiple locations at which a specified activity is accomplished. In some instances, the various elements performing a function at a given site may be at multiple physical locations, possibly separated by significant distances.

The following is a table of acronyms used in this application:

| | |
|---|---|
| AR | ascending register |
| ATM | asynchronous transfer mode |
| DR | descending register |
| DSA | digital signature algorithm |
| DSL | digital subscriber line |
| ECDSA | elliptic curve digital signature algorithm |
| IBIP | Information-Based Indicia Program |
| ISDN | integrated digital services network |
| MI code | mailpiece identification code |
| MICA | MI code applying device |
| MIG | MI generator |
| MPS | mail processing station |
| PC | personal computer |
| PSD | postal security device |
| PSS | postal service system |
| PV | postage vendor |
| PVS | postage vendor system |
| RAM | random access memory |
| ROM | read only memory |
| RSA | Rivest-Shamir-Adelman (a public key encryption technique) |
| SMD | secure metering device |
| USPS | United States Postal Service |

System Overview

FIG. 1 is a block diagram of a mailpiece franking, tracking, and accounting system 10 in an embodiment of the present invention. In this system, there are three parties, mailers collectively, a postage vendor (PV), and a postal service or authority. The PV is an entity such as Neopost Inc. or Pitney Bowes Inc. that has been approved by the postal service to sell postage (e.g., by funding postage meters). A postage vendor system (PVS) 15 communicates with a plurality of devices (meters 20 and user computers) that apply MI codes to mailpieces via a communications network 25, and also with a plurality of the postal service's mail processing stations (MPSs) 30 via a communications network 35. The meters are denoted schematically as circles with an "M" in the center, and the MPSs are denoted schematically as circles with a "P" in the center. PVS 15 also communicates with a postal service system (PSS) 40. The communication between the PVS and the PSS is shown as being via a dedicated link, but the communication can instead or additionally be via network 35.

The user computers are usually associated with the mailers, but may also be kiosks operated by the postal service.

Thus, one of the user computers is designated with the reference numeral 22G (general purpose computer) while another one is designated with the reference numeral 22K (kiosk). For convenience, the user computers are referred to generically as user computers 22 where the distinction between general purpose computers and kiosks is not relevant. In any event, the user computers may provide a variety of different functionalities, including one or more of the following:

- Operate as self-contained kiosks printing indicia including MI codes according to the invention;
- Operate as host computers for meters printing indicia including MI codes according to the invention;
- Operate as host computers in accordance with relevant open systems specifications, and also print indicia including MI codes according to the present invention using a general purpose printer;
- Operate as host computers to print indicia including MI codes according to the invention using a general purpose printer;
- Operate as host computers to control a large printing and mailing facility using specialized printers and other mailpiece preparation equipment; and
- Provide communication between the mailer and the PVS.

The meters and user computers are examples of devices that apply MI codes, and are collectively referred to as MI code applying devices (MICAs).

Networks 30 and 35 are shown as a separate networks, but maybe the same network. However, the communications with the meters and with the MPSs are qualitatively different, as will be discussed in detail below. The PVS and PSS are shown schematically as single blocks, but one or both may include multiple computers communicating with each other via one or more additional networks (not shown). It should also be recognized that a mailpiece may encounter more than one processing station in a mail processing facility. The MPSs that are relevant to the invention and are schematically illustrated are ones that communicate with the PVS. Furthermore, a system embodying the present invention does not have to include meters and user computers, but could be based on a single type, or a limited subset of types, of devices that apply MI codes to mailpieces.

In operation, meters 20 (and possibly some user computers 22) print indicia that include unique mailpiece identification (MI) codes (sometimes referred to simply as "codes") on mailpieces 45. One mailpiece is shown in enlarged form, and is shown schematically working its way through a plurality of MPSs from a first MPS 30(first) to a last MPS 30(last). A mailpiece normally includes a destination address 50, a return address 52, a destination barcode such as a POSTNET barcode 55, and some kind of postal indicium. Destination barcode 55 may be created and printed by the mailer, or, if absent, is applied to the mailpiece the first time it enters the postal system (as for example at MPS 30(first)).

In accordance with embodiments of the present invention, the meter prints indicia having a human-readable portion 60 and a machine-readable portion 65 (drawn schematically as a grid). The human readable portion is shown as a large, apparently random number. This is the unique MI code, which is also encoded in the machine-readable portion of the indicium. The machine-readable portion can also encode information in addition to the MI code, such as a postage value or other information required by the postal service. Machine-readable portion 65 can be a two-dimensional barcode such as PDF417, a matrix symbol such as Data Matrix, or can be a one-dimensional barcode. In some implementations, PVS 15 generates the MI codes and other indicium information and sends them to the meters; in other implementations, the meters generate the MI codes and other indicium information and send them to the PVS; and in some implementations, meters are capable of operating in either mode.

A meter is a specific instance of an instrumentality that places MI codes on mailpieces, and communicates with PVS 15 to receive MI codes from the PVS and/or to report to the PVS MI codes that it has used. In fact, large mass mailings are not processed by meters at all. Rather a form of indicium (e.g., stating that postage has been paid by the company responsible for the mailing), and address information from a mailer's database is printed on the mailpieces. In such a scenario, the mailer could request a block of MI codes for a specific mailing from the PVS or generate a block and report them to the PVS. Particular ways to ensure uniqueness of MI codes are discussed below. At this point it suffices to note that an MI code should have the property that it can be associated with an authorized (licensed) mailer or meter.

Regardless of how or where the MI code was generated, a given mailpiece encounters MPS 30(first), which scans the machine-readable portion of the indicium (which includes the MI code and possibly other information) and also scans the destination barcode (or prints one if it doesn't detect one). The postal service may rate the mailpiece or extract the postage amount from the indicium information. MPS 30(first) then sends a mailpiece message to PVS 15. In this context, the term mailpiece message refers to information that is returned from one of the MPSs in response to that MPS processing a mailpiece bearing an MI code. A mailpiece message would include, at a minimum, the MI code and the current location of the mailpiece (which is inherently provided by the MPS identification in the message). The mailpiece message may also include the mailpiece destination and the amount of postage. As the mailpiece passes through each of the other MPSs, the mailpiece is again scanned and a mailpiece message is sent to the PVS. The processing of mailpiece messages by the PVS is described in detail below; at this point it suffices to note that the PVS maintains a database 70 that is available for user queries for tracking and accounting purposes.

Since the MI code is required to uniquely identify the mailpiece to which it is applied, a given code passes through a number of states during its life. When a code first appears on a mailpiece that is scanned at an MPS and reported to the PVS, it becomes an active code. As mentioned above, MI codes may be generated and issued by the PVS, or may be generated by the meters, applied to mailpieces, and later reported to the PVS. Accordingly, the invention contemplates that some MI codes will appear on mailpieces before the PVS knows that they exist. This would be the case, for example, where a meter generates valid MI codes and applies those MI codes to mailpieces that enter the mail system before the meter has notified the PVS that it has generated and applied those codes. When the mailpiece reaches its final destination (the last time it is scanned by an MPS or mail delivery person, the code is retired, and should not appear again. However, in some embodiments, MI codes can repeat, but only after a prescribed period of time, for example 60 days or one year.

As mentioned, it is an aspect of the invention that each mailpiece bear a unique MI code, i.e., some combination of information that is enough to uniquely identify that mailpiece. While the PVS has the ability to insure uniqueness of MI codes that it generates and issues, codes generated at one mailer's site must be constrained in a manner that they do not conflict (i.e., coincide) with codes generated at another mailer's site.

It is long established practice that every postage meter have a unique identification code (meter ID), and IBIP specifies that every PSD have a unique ID (PSD manufacturer, model, and serial number). Therefore, one way to insure uniqueness is to assign each MI code generator a unique MI generator code (MIG code) and require that each MI code include a portion (referred to as the MI code trailer) that is unique to the entity generating the MI code and another portion that is different for every MI code generated by that entity. Thus each meter (or licensed mailer) could generate the same sequence of numbers (MI code trailers), each MI code trailer to be combined with its MIG code to define the MI code. The PVS, which generates MI codes would have its own set of one or more MIG codes. To the extent that the meter is also a meter that generates conventional or IBIP-like indicia, the meter's MIG code could be the same as the meter ID, even though postage for the indicia containing MI codes would not be accounted for in the meter as are conventional indicia.

As a general matter, there may be more than a single PV under whose authority MI codes are generated. In such cases, there would be multiple PVSs, and each MI code would need to identify the PV so that the MPS would send the mailpiece message to the correct PVS. This is automatically taken care of if the MIG code is required to identify the PV along the lines of the requirement that every postage meter indicium is required to identify the manufacturer (i.e., the PV).

PVS Processing of Mailpiece Messages

Figure 2:
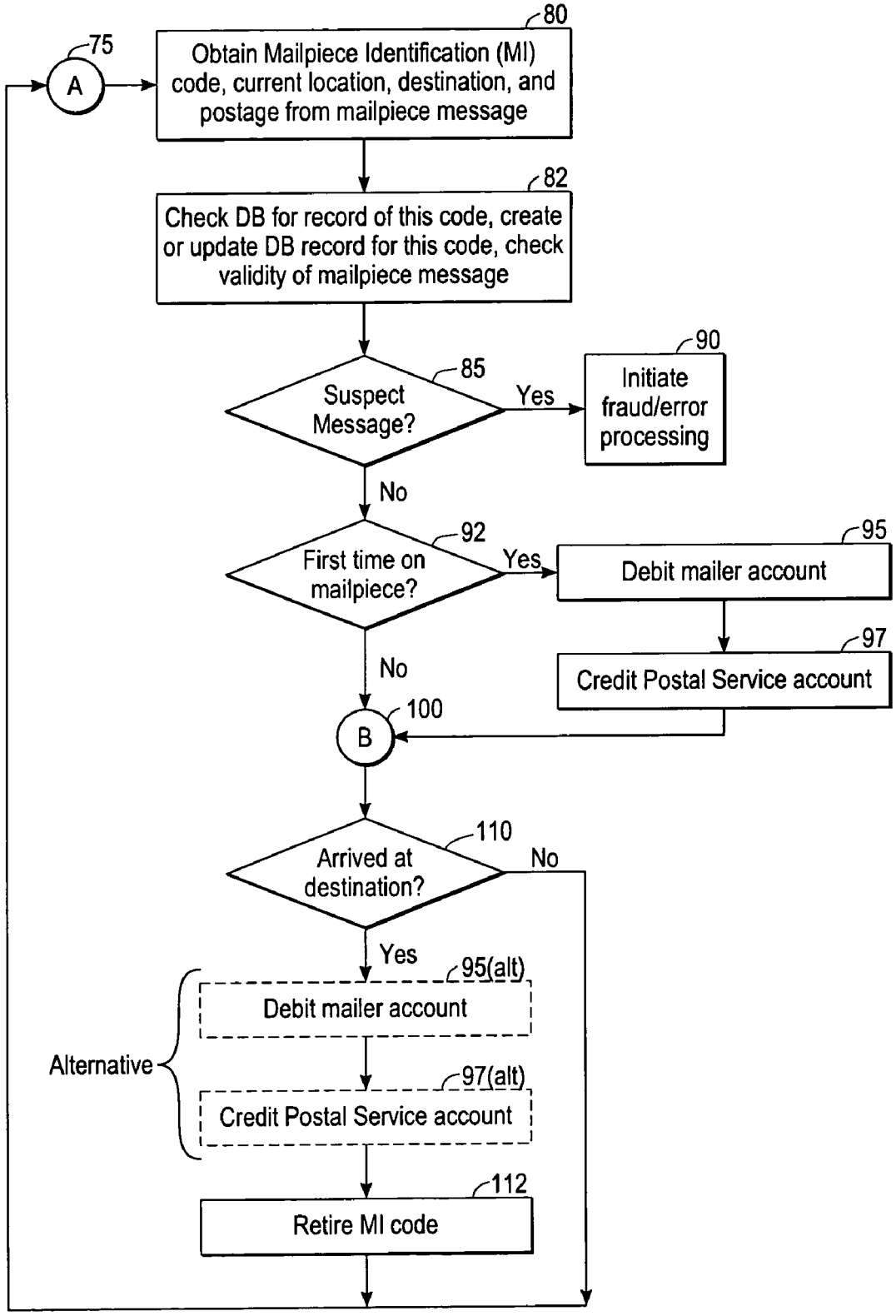
FIG. 2 is a flowchart showing representative processing of a mailpiece message received from a postal scanning station in an embodiment of the present invention.

FIG. 2 is a flowchart showing a representative processing sequence carried out by PVS 15 in response to receiving mailpiece messages from MPSs 30. This flowchart is drawn at a high level and represents a particular implementation of some of the logic branches. A flowchart is a structured representation, while the actual programming constructs are preferably object oriented. Further, the actual programming relies on interrupts, which are not explicitly shown. The particular conditions that give rise to interrupts include such events as receiving a mailpiece message from one of the MPSs. Consider the program to have a return or rest state "A" designated with the reference numeral 75. As shown in the flowchart, the program returns to this state when it has finished processing a mailpiece message, and leaves this state when it has a new mailpiece message to process.

Upon receipt of the mailpiece message, the relevant information is obtained from the message at a step 80, and the MI code is examined. At a step 82, the database is accessed to see if a record already exists for this MI code, a record is created if there is no existing record, and the database record is updated to reflect the content of the mailpiece message. After updating, the database record corresponding to the MI code will reflect the current location, the destination, and the postage for the mailpiece. The transaction record provided by the meter or mailer could contain additional information, which would also be part of the database record. In general, the PVS will normally have received transaction records for most mailpieces before the mailpieces enter the mail stream since the mailer is normally required to send the transaction records to the PVS promptly after applying the MI codes to mailpieces.

The message content is checked at a branch step 85 to determine whether there are any irregularities that make the message, and therefore the mailpiece giving rise to the message, suspect (possibly fraudulent). Suspicion could arise for a number of reasons, such as an invalid MI code, a retired MI code, or any inconsistency in the message information (e.g., with respect to earlier messages for that MI code). A detailed discussion of various reasons to consider a mailpiece message suspect is provided in a later section. At this point it suffices to say that if it is determined that the message is suspect, fraud/error processing is initiated at a step 90. In some instances, the fraud/error processing may entail nothing more than flagging the database record for follow-up when the next message corresponding to that MI code is received. To the extent that the MI code had not previously been in the database, the validity test is whether the MI code is one that could validly have been generated by an authorized mailer. However, as will be discussed below, the absence of the MI code in the database could be cause to flag the newly created database record for follow-up.

A branch step 92 determines whether this is the first reporting of the MI code on a mailpiece in the system. This is inherently determined at step 82, but in the described implementation, is not acted on until after the mailpiece message is processed at branch step 85. If it is determined that this is the first time that the MI code has been reported, in a preferred implementation, the mailer account is debited at a step 95 and the postal service account is credited at a step 97. The program then returns to a state "B" designated with the reference numeral 100.

In some situations, the mailer would have already paid the PV for one or more MI codes, and the MI codes and/or their database records would indicate that they had been prepaid. In these situations, step 95 of debiting a mailer account would not occur in this sequence since it would have, in effect, occurred before the mailpiece entered the mail stream. In a variant of this, the mailer might pay a fraction of the postage at the time of obtaining the MI codes, and the mailer account is only debited by the remaining unpaid portion of the postage.

A branch step 110 tests (by comparing the current location to the destination) to determine whether the mailpiece has arrived at its destination. If branch step 110 determines that the mailpiece has arrived at its destination, the MI code is retired at a step 112 and the program returns to state "A" to wait a new mailpiece message from one of the MPSs. If the mailpiece has not arrived at its destination, the program returns to state "A."

It is noted that in an alternative embodiment, steps 95 and 97 of debiting the mailer account and crediting the postal service account could be performed at the time that the mailpiece has actually arrived at its destination, and these steps are therefore shown in phantom and designated with reference numerals 95(alt) and 97(alt) in the path where branch step 110 has determined that the mailpiece has arrived at its destination. Also, the tests performed by branch steps 85, 92, and 110 could be performed in a different order or combined differently. For example, the MI code could first be tested to determine whether it is the first appearance on a mailpiece, and then tested for validity (with retired status being a type of invalidity). The preferred order and details will in general depend on the particular way the MI database is organized.

Error and Fraud Processing

Figure 3:
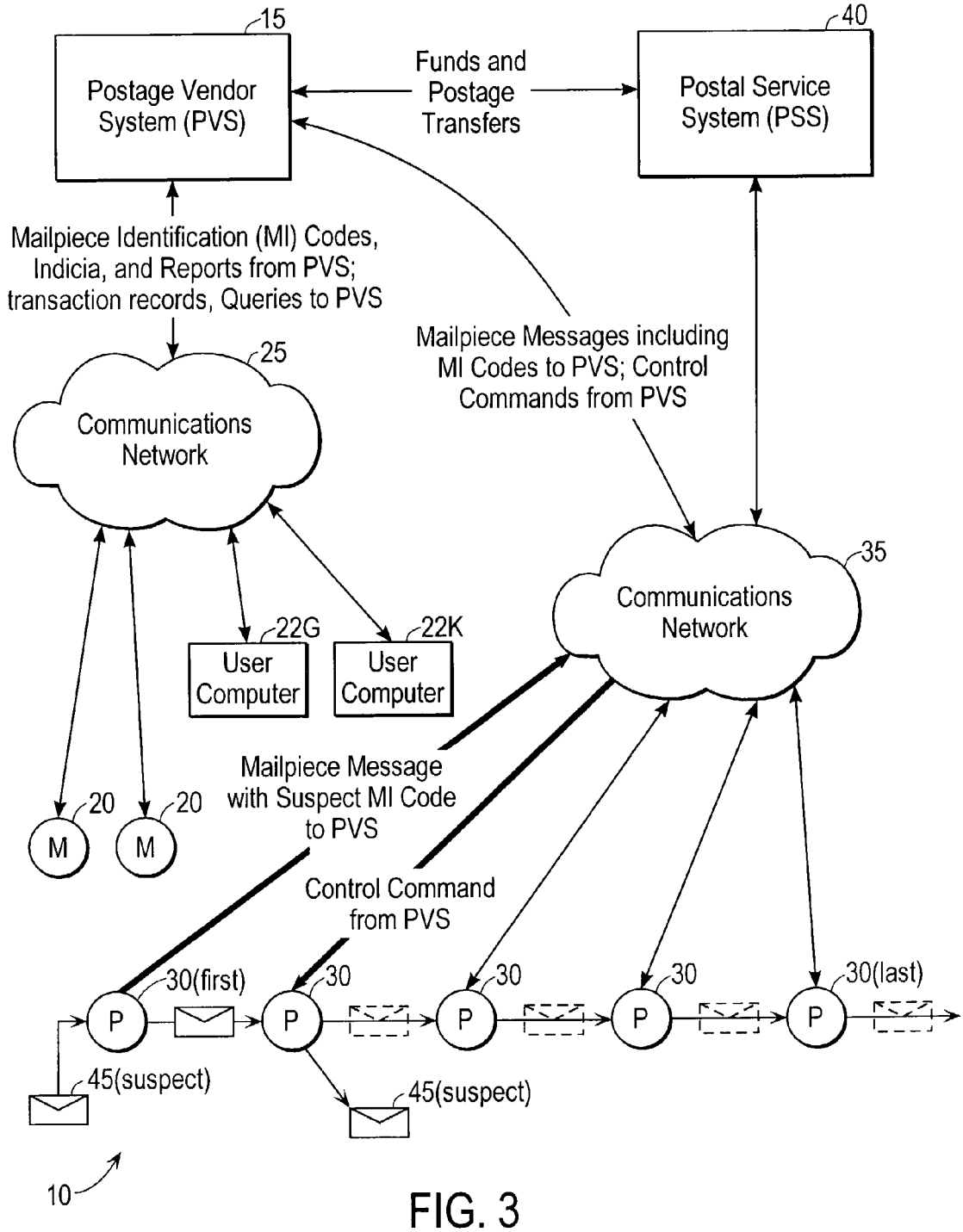
FIG. 3 is a block diagram showing schematically the operation of the system of FIG. 1 in connection with detecting a suspect mailpiece.

FIG. 3 is a block diagram showing schematically the operation of system 10 in connection with receiving a suspect mailpiece message. A "suspect" mailpiece message refers to a message that, when processed by PVS 15, indicates a suspect (possibly fraudulent) mailpiece. It should also be realized, however, that a suspect mailpiece may not be fraudulent, but may result from improper application of the MI code or other indicium information, or improper scanning at the MPS. The suspect mailpiece is designated with the reference numeral 45(suspect), and the MI code for the suspect mailpiece will be referred to as the suspect MI code. The flow of mailpiece messages and commands for a typical error detection and processing scenario is shown with heavy arrow lines. Thus a suspect mailpiece message relating to the suspect mailpiece is shown as being sent from MPS 30(first) to PVS 15 via network 35. The fact that the mailpiece is suspect is, of course, not yet known, since the mailpiece message has not been processed by the PVS. Further, depending on the nature of the problem, the suspect message may originate with a different MPS than the first MPS encountered by the suspect mailpiece.

In response to detecting a suspect mailpiece, PVS 15 sends a command to a downstream MPS, in this case shown as the second MPS encountered by mailpiece 45(suspect). The resulting action taken at the MPS is shown schematically as the mailpiece being diverted from the mail stream for further inspection and processing. The reason for diverting the suspect mailpiece at a downstream MPS is that there is generally no way for the MPS that scanned the mailpiece to determine that the mailpiece is suspect. By the time that the PVS has made that determination, the mailpiece is generally beyond the reach of the MPS that sent the suspect message (in this example, MPS 30(first)).

The particular criteria by which a message is judged to be suspect is in general a matter of implementation and design choice. A number of circumstances that might be considered suspect are set forth below. One such circumstance is that the mailpiece bears a retired MI code. Alternatively, the MI code may be an apparently valid code, but the mailpiece message may be inconsistent with information already stored in the database record corresponding to this MI code. In one example, the MI code could have been generated with a particular postage amount indicated, and the mailpiece message could indicate a different postage amount. In another example, the mailpiece message may contain a different destination code than the destination code previously associated with that MI code.

In yet another example, the destination code may be correct, but the location of the MPS sending the mailpiece message may be inconsistent with proper routing of the mailpiece in view of the information regarding the MPS that generated a previous mailpiece message for this MI code. This could indicate that multiple mailpieces bearing the same MI code have been introduced into the mail stream.

It should also be recognized that there may be a number of circumstances where a mailpiece message is suspect, but the mailpiece giving rise to that message is actually genuine. Accordingly, the procedures will normally take these factors into account. For example, occasional scanning errors can result in PVS 15 making a determination that a mailpiece is bearing an invalid MI code, when such is not actually the case. Therefore, one possible approach is to scan the suspect mailpiece after it has been diverted. In fact, if the suspicion arose because an MI code was incorrectly scanned, the mailpiece, which is in fact bearing a valid MI code will not be diverted because the diversion command will refer to the incorrectly scanned MI code. However, the downstream MPS's mailpiece message for that mailpiece may be considered suspect because the expected message from the upstream MPS was not received (i.e., the message received for the mailpiece was not associated with the correct MI code).

For some types of attempted fraud, it may be the mailer rather than the PVS that detects a suspect pattern. For example, part of the routine processing typically entails having the mailer receive a report of transactions charged to that mailer's account. This can be done automatically by the PVS, or the mailer could query the PVS database and download transaction records. Since the mailer would be in a position to know what mailpieces were intended to be introduced into the mail stream, the detection of additional mailpieces could be a sign of fraud. Note that this provides the mailer better information than would be the case with conventional meters, where the mailer would only know that an excessive amount of postage was charged to the meter without having the benefit of a transaction log from the PVS.

The PVS can also detect mailpiece message patterns that are suspect, even if none of the individual messages are suspect. By tracking patterns of normal usage by mailers, abnormal patterns can be flagged and brought to the mailers' attention. Similarly, even if there is no fraud, the PVS can detect patterns that suggest improper application of the MI codes by particular mailers or improper scanning by particular MPSs. The particular actions taken may depend on the frequency in space and time of suspect messages. For example, if the suspect messages seem to be isolated occurrences, it may be inappropriate to divert mailpieces until a pattern emerges. However, the PVS would normally log the suspect messages for determining whether a pattern is emerging.

As discussed above, the tracking and retiring of MI codes provides security with respect to repeated use of the same MI code. Thus a would be perpetrator of a fraud would not succeed by merely duplicating existing MI codes. However, there is a potential risk where the would-be perpetrator anticipated a series of MI codes that could legitimately be generated in the future, and applied those codes to mailpieces before the legitimate mailer applied them. The mailer would be charged, and the fraud would never be uncovered if the mailer was not diligent in checking statements of mailpiece transactions charged to the mailer's account.

This is not an issue if the PVS flags as suspect any MI code that doesn't have a record in the database. A legitimate MI code will be absent from the database when the mailer has generated the MI code and applied it to a mailpiece, but has not sent the transaction record to the PVS by the time the MI code appears in a mailpiece message. In most instances, however, the transaction record will have been sent to the PVS before the mailpiece has reached its destination. Thus, the PVS could flag the MI code as suspect, and only instruct the last MPS to divert the mailpiece if the PVS has not received a corresponding transaction record by the time the mailpiece reaches the second or third to last MPS.

The PV and the mailer can allocate the risk of fraudulent use of the mailer's MIG code by specifying the degree to which a mailpiece is allowed to proceed along its travel to its destination without there being a corresponding transaction record in the database. If the mailer is unwilling or unable to promptly send transaction records to the PV, the mailer could specify that it is willing to bear the risk that mailpieces are diverted early in the process and delayed, or could specify that it was willing to bear some risk of fraud by allowing the mailpieces to proceed to their destinations without being diverted.

Tracking and Accounting for Reply Mailpieces

As mentioned in the Background section, the Origin Confirm® service tracks incoming reply mailpieces by having provided a PLANET™ code on the reply mailpiece. Embodiments of the present invention expand on this concept in a number of ways, as will now be described. In broad terms, the transaction can be summarized as follows. The mailer, or someone acting on behalf of the mailer, sends an outgoing mailpiece to a recipient, and the recipient uses information and typically one or more components of the outgoing mailpiece to generate a reply mailpiece. The reply mailpiece bears a visible indication of an MI code that uniquely identifies the reply mailpiece, with the MI code having been provided to the recipient by the mailer so that the recipient can track the reply mailpiece. The postage for the reply mailpiece is debited to a mailer account.

The invention does not require any particular format for the outgoing and reply mailpieces, but the particular embodiment described below is typical of the type of bill that a utility would send one of its customers and the type of reply that the customer would send with a payment. In such an environment, the outgoing mailpiece envelope contains a bill and a reply envelope. The bill typically includes a portion that is intended to be separated from the rest of the bill and sent back in the reply envelope along with a check. Thus, the bill can be considered to have a recipient portion, which is retained by the recipient, and a reply portion, which is sent as part of the reply mailpiece. For a single-page bill, the sheet is typically divided into two segments, a reply segment and a recipient segment, with the reply segment sized to fit in the reply envelope. Even when the bill contains multiple pages, such as a billing summary on the first page and transaction details on subsequent pages, the first page is typically segmented to provide the reply segment. The reply segment may also be referred to as the reply insert.

Figure 4:
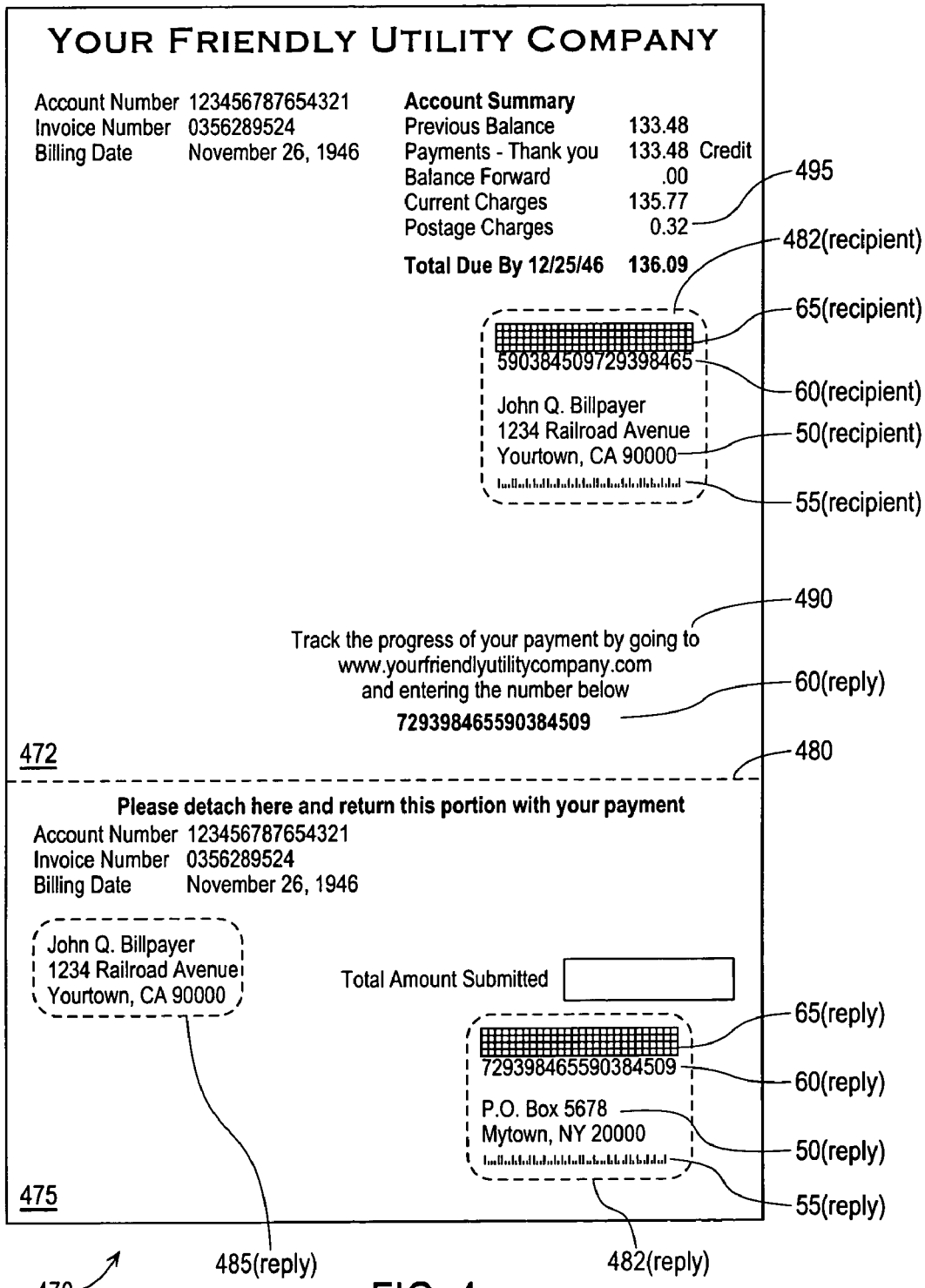
FIG. 4 is a schematic view of a representative mailpiece insert suitable for use in performing a method in an embodiment of the invention.

FIG. 4 is a schematic view of a front page (or possibly the only page) of a representative mailpiece insert 470. This insert can be used in performing a method in accordance with an embodiment of the invention. Insert 470 is shown as including standard information that would normally be expected to appear on a bill, such as account information and the like. This page of insert 470 includes a recipient segment 472 and a reply segment 475, which are separated by a separation line 480. Separation line 480 could be a tear line, for example a scored line or a line of perforations, or could be a printed line along which the user is instructed to cut to separate the two segments of the sheet. Each of the insert segments includes a number of elements that correspond to elements on mailpiece 45 illustrated in FIG. 1, and the same reference numerals will be used, but with a suffix "(recipient)" or "(reply)," depending on the segment of the insert on which the element resides. In a like manner, where the recipient and reply segments contain a corresponding element, the same suffix notation will be used.

In this particular embodiment, the insert is used in connection with outgoing and reply envelopes, and particular information is printed in regions that are registered with openings (windows) in the front faces of the envelopes so that this information is visible after the insert is inside the envelope. To this end, recipient segment 472 includes a recipient address 50(recipient), a recipient destination code 55(recipient), a recipient MI code 60(recipient) in human-readable form and indicium information 65(recipient) in machine-readable form, all located within a region 482 (recipient). Similarly, reply segment 475 includes a reply address 50(reply), a reply destination code 55(reply), a recipient MI code 60(reply) in human-readable form and indicium information 65(reply) in machine-readable form, all located within a region 482(reply). As mentioned above, the machine-readable indicium information includes at least the MI code. Reply segment 475 also includes the recipient address as a return address in a region 485(reply) to function as a return address on the reply mailpiece.

Recipient and reply segments are in most material respects like mailpiece 45, with the following exceptions. First, MI code 60(reply) is generated by or for the mailer, is associated with an account of the mailer, and therefore results in the postage for the reply mailpiece to be charged to the mailer. In current practice, mailers such as utility companies and phone companies do not provide postage prepaid envelopes. This can lead to many bill payments being delayed or lost due to a lack of sufficient postage.

As illustrated here, the mailer passes a postage charge on to the recipient, as indicated at 495 as a postage charge added to the current charges. Subject to possible contractual or regulatory considerations, the mailer can charge the recipient the normal first class postage rate that the recipient would normally pay, the possibly discounted rate that the mailer is charged, a rate in between the two, or a rate greater than the first class rate. Alternatively, the mailer could determine that it was appropriate not to charge the recipient for the postage at all.

Another feature that is shown on recipient segment 472 is an indication of reply MI code 60(reply). Since segment 472 is retained by the recipient, the recipient can track the progress of the reply mailpiece including the return payment. Thus, both the mailer and the recipient can track the reply mailpiece. This allows the recipient to determine if and when the payment is received, and provides evidence if there were a dispute between the mailer and the recipient on this point. The recipient segment also includes a message 490 instructing the recipient how to make use of the reply MI code 60(reply) to track the reply mailpiece.

While the specific illustrated embodiment shows recipient segment as including a recipient MI code 60(recipient), there is no fundamental reason that the mailer avail itself of the tracking and accounting features of the present invention for the outgoing mailpieces. Thus, the mailer can continue with its normal permit bulk mailing, and merely provide the MI code 60(recipient) which accounts for postage as well as provides tracking on the reply mailpiece. However, the outgoing MI code would provide evidence if there were a dispute between the mailer and the recipient whether and when the bill was received.

Figure 5:
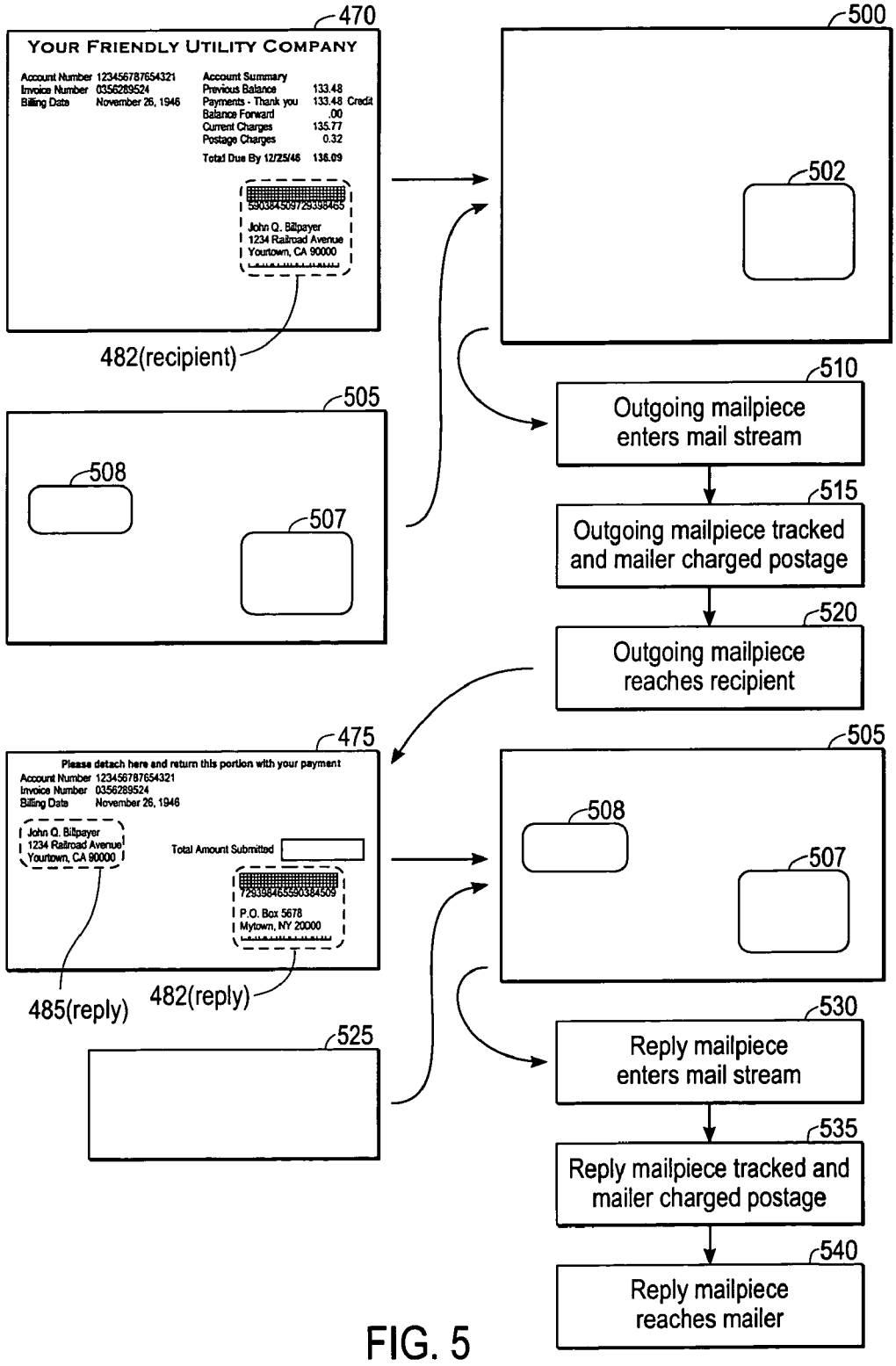
FIG. 5 shows schematically the overall operation of the method of using mailpieces that are supported by the insert of FIG. 4.

FIG. 5 shows schematically the overall operation of the method of using mailpieces based on the insert of FIG. 4. In particular, an outgoing mailpiece is produced by placing insert 470(shown as having been folded in half) into an outgoing envelope 500. The outgoing envelope has an opening 502 sized to register with region 482(recipient) on segment 472 and thus expose the information printed in that region. Also included in the outgoing mailpiece is a reply envelope 505 having openings 507 and 508 sized to register with regions 482(reply) and 485(reply) on segment 475 and thus expose the information printed in those regions where segment 475 is placed in the reply envelope.

The outgoing mailpiece enters the mail stream (step 510). In embodiments where the outgoing mailpiece includes a visible MI code 60(recipient), the outgoing mailpiece is tracked at successive mail processing systems 30 (FIG. 1) and the mailer is charged for the postage as described above (step 515). In any event, the outgoing mailpiece finally arrives at its destination and is delivered to the recipient (step 520).

The recipient removes insert 470 and reply envelope 505 from outgoing envelope 500, and separates reply segment 475 from insert 470. The recipient generates the reply mailpiece by inserting the reply segment into the reply envelope, possibly along with an additional mailpiece component 525, such as a payment check. If the recipient is paying by credit card, relevant information would be provided on a portion of reply segment 475 that is not visible outside the envelope.

Reply segment 475 and additional component 525 (if any) are inserted into reply envelope 505 with the information in area 482(reply) and 485(reply) showing through openings 507 and 508 in reply envelope 505. The recipient mails the reply mailpiece, which then enters the mail stream (step 530). Since the reply mailpiece bears reply MI code 60(reply), the reply mailpiece is tracked and the mailer is charged for the postage (step 535). The reply mailpiece then reaches the mailer (step 540).

As noted above, the specific illustrated mailpiece components are but one example, and other types of mailpieces can be used. For example, the information shown as being printed on the insert segments and visible through the openings in the envelopes could be applied to the outside of the envelope, or certain elements of the information could be applied to the outside of the envelope. All that is required for reply MI code 60(reply) to be effective for tracking and for charging the mailer is that the reply mailpiece bear a visible indication of the reply MI code. Similarly it is only necessary that the reply mailpiece bear a visible indication of the reply address and reply destination code. The same comments apply to the outgoing mailpiece, with the caveat that the invention in its broader aspect does not require the use of recipient MI code 60(recipient).

Further, the outgoing and reply mailpieces need not be based on conventional envelopes. For example, the reply mailpiece can be a single sheet that is included in the outgoing envelope. Such a sheet would have the appropriate printed information and adhesive portions so that the recipient would assemble the reply mailpiece with the proper information on the outside and the proper private information on the inside.

Client System Computer Configuration

Figure 6:
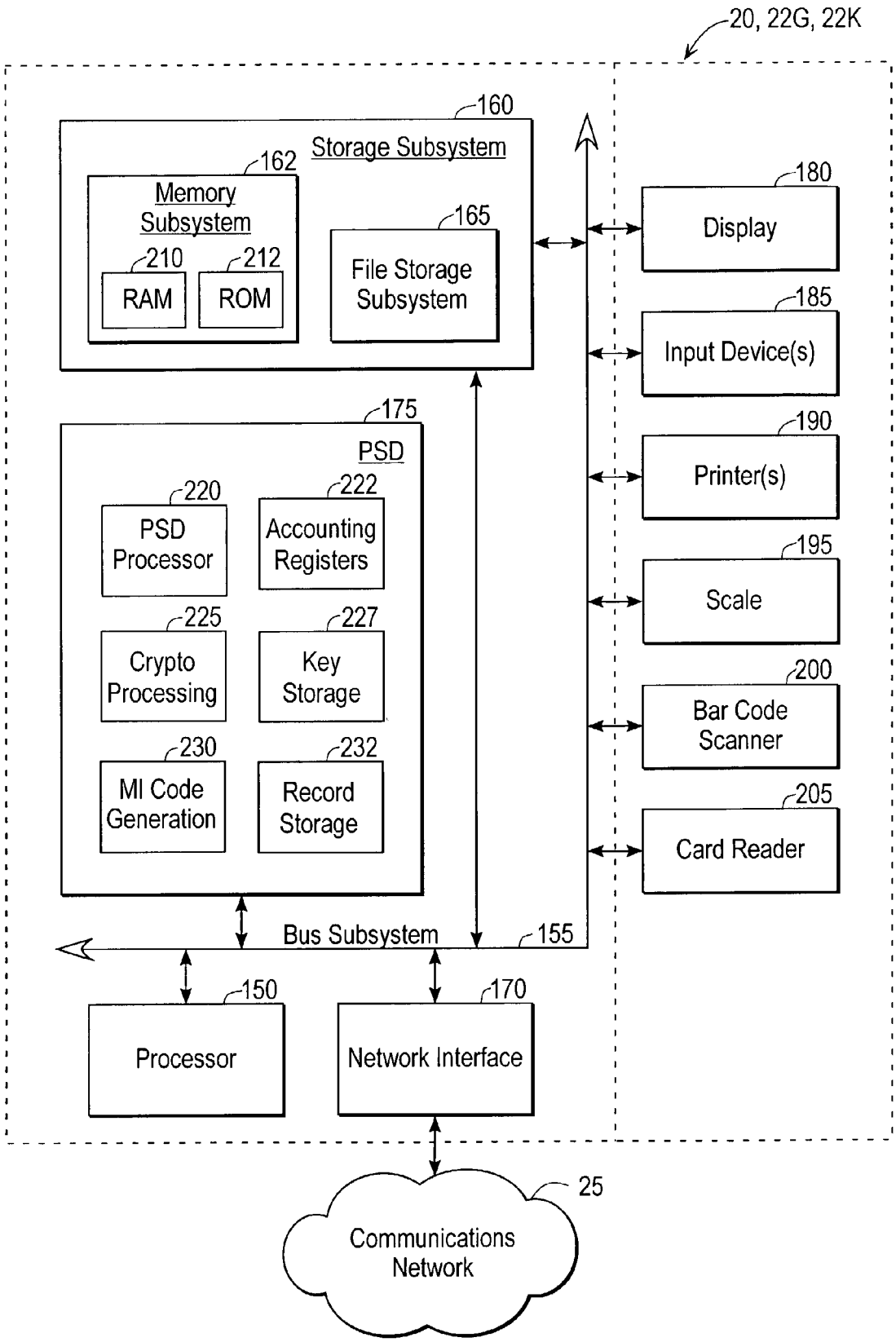
FIG. 6 is a block diagram of an exemplary hardware configuration of a meter or user computer suitable for use with embodiments of the invention.

FIG. 6 is a simplified block diagram of an exemplary hardware configuration of a meter 20 or user computer 22G/22K suitable for use with the invention. The meters and user computers generally act as clients with PVS 15 acting as a server; therefore, the meters and user computers will be collectively and generically referred to as the client systems, or simply clients. The client system may also be configured to print other types of indicia such as indicia along the general lines set forth in the IBIP specifications (possibly omitting certain specified indicia elements). A suitable user computer would be personal computer (PC) running Microsoft's Windows NT™ operating system, but the user computer can be based on any other computer system (e.g., a workstation, a computer terminal, a network computer, a mainframe) so long ms the computer system can perform the required functions. The meter is typically based on a RISC processor or other embedded controller.

The client system typically includes at least one processor 150, which communicates with a number of peripheral devices via a bus subsystem 155. These peripheral devices typically include a storage subsystem 160, comprising a memory subsystem 162 and a file storage subsystem 165, user interface input devices, user interface output devices, and a network interface subsystem 170. The figure is generic in that for some implementations, some of the peripheral devices would be integral with the main device housing, while for others, the peripheral devices would be external. The dashed lines are suggestive rather than definitive. Although bus subsystem 155 is shown schematically as a single bus, embodiment of the bus subsystem may utilize multiple buses.

In order to support the ability to print conventional indicia where postage is accounted for locally, the client system is shown as including a postal security device (PSD) 175, which perform functions along the lines of the PSD specified by the USPS's IBIP specifications. The PSD is a specific instance of a more general secure metering device (SMD) class where other types of value indicia can be generated. Even if the client system is only used to print indicia according to embodiments of the invention, some embodiments of the invention can be advantageously supported by the digital signature and secure storage capabilities of the PSD.

The input and output devices allow user interaction with the client system. In general, use of the term "input device" is intended to include all possible types of devices and ways to input information into the client for communication via communications network 25. Similarly, the term "output device" is intended to include all possible types of devices and ways to output information from the client system to a user or to another machine or computer system.

Network interface subsystem 170 provides an interface to outside networks, including an interface to communications network 25, and is coupled via communications network 25 to cooperating interface devices in other computer systems. The network interface may include, for example, a modem, an Integrated Digital Services Network (ISDN) device, an Asynchronous Transfer Mode (ATM) device, a Direct Subscriber Line (DSL) device, a fiber optic device, an Ethernet card, a cable TV device, or a wireless device.

In general, the peripheral devices are configured in a manner appropriate to the particular type of client system. The peripheral devices include a display 180, one or more input devices (keypad, pointing devices, etc.) 185, and one or more printers 190. Depending on the type of client system, the peripheral devices might include one or more of a scale 195, a barcode scanner 200, and a credit card or smart card reader 205. In the case of a kiosk, the display and keypad might be integrated as a touch screen, and the printer scale, barcode scanner, and card reader, to the extent present, would typically be built into the kiosk's secure housing. In the case of a meter, the display, printer, and keypad would typically be separate devices integrated into the meter's secure housing, and the scale and barcode scanner would be external devices. In the case of a general purpose computer such as a PC, the input devices would typically include a keyboard and a pointing device such as a mouse or trackball, and the other peripherals would be external devices. Printer(s) 190 include at least an indicium printer, and possibly one or more additional printers for printing receipts, reports delivery confirmation, general postal information, and the like.

Storage subsystem 160 stores the basic programming and data constructs that provide the functionality of the client system. For example, the various program modules and databases implementing the functionality of the present invention may be stored in storage subsystem 160. These software modules are generally executed by processor(s) 150.

Memory subsystem 162 typically includes a number of memories including a main random access memory (RAM)

210 for storage of instructions and data during program execution and a read only memory (ROM) 212 in which fixed instructions are stored. File storage subsystem 165 provides persistent (non-volatile) storage for program and data files, and typically includes a hard disk drive. While a kiosk's computer system is not accessible to members of the public, the storage subsystem preferably includes one or more drives for reading and writing removable media for maintenance and upgrade purposes, especially when the kiosk is not connected to any network. Such drives could include one or more of a floppy disk drive, a CD-ROM drive, a CD-R drive, a DVD drive, and the like.

Postal Security Device (PSD) Configuration

To the extent that the client system is also configured to print conventional or IBIP-like indicia, it includes PSD 175. The PSD will be described as providing the full functionality to print such indicia, but as mentioned above, the client system may make use of only part of the functionality. Specifically, the invention in its broader aspects does not rely on secure accounting registers of the client, nor do the indicia rely on digital signatures. In the case of a meter or a kiosk, the PSD is located within the secure housing, while in the case of a general purpose computer, the PSD would typically be connected via a cable or inserted in a card slot. In some implementations that print IBIP-like indicia, the PSD functionality is located at the PVS.

PSD 175 includes a processor 220 to perform functions along the lines of the PSD specified by the USPS's IBIP specifications. Part of the functionality, which is actually a more general postage meter requirement, is that the PSD store and manipulate accounting registers (e.g., an ascending register (AR) value, a descending register (DR) value, maximum and minimum postage values), a unique meter number, and originating address. This is shown as an accounting registers block 222. The IBIP specifies the meter number to include, in a specific format, the PSD manufacturer ID assigned by the USPS, the PSD model ID, and the PSD serial number assigned by the PSD manufacturer.

Further in accordance with the IBIP PSD requirements, the PSD includes cryptographic software 225 to enable processor 220 to perform cryptographic processing, including generating a key pair and generating and verifying digital signatures in accordance with the algorithm that is used by the particular digital signature technique (e.g., DSA, RSA, ECDSA). The current specific PSD embodiments use DSA and ECDSA. In support of the digital signature functionality, the PSD also stores the PSD X.509 certificate serial number, the PSD private key, and the IBIP common parameters that are used for the digital signature generation and verification. This is shown as a key storage block 227. While some embodiments of the present invention create indicia without digital signatures, digital signatures are likely to be required to support device audit and postage value download transactions, and may also be used in support of other functions such as sending transaction records to the PVS.

PSD 175 preferably includes two additional elements that are used to support certain embodiments: software 230 to support the generation of unique MI codes, and non-volatile storage 232 for transaction records. As will be discussed below, the transaction records are periodically sent to PVS 15 over communications network 25 or by some other authorized pathway.

Although a single processor is capable of performing all the PSD functions discussed above, cryptographic processing and MI code generation could be performed by separate processors or special purpose hardware. Conversely, a meter could be designed so that a single PSD processor handled all the meter functions. It is also possible that transaction records could be stored in the client system outside the PSD. As mentioned above, the client systems periodically send the transaction records to PVS 15. This could occur as a two-step process. For example, the PSD could store up to a certain number of transaction records inside the PSD, and then send them for temporary storage in the client system's storage subsystem 160. Indeed, the transaction records could be stored in other locations, such as on another computer in communication with the client system.

Postage Vendor System (PVS) Configuration

Overview

Figure 7:
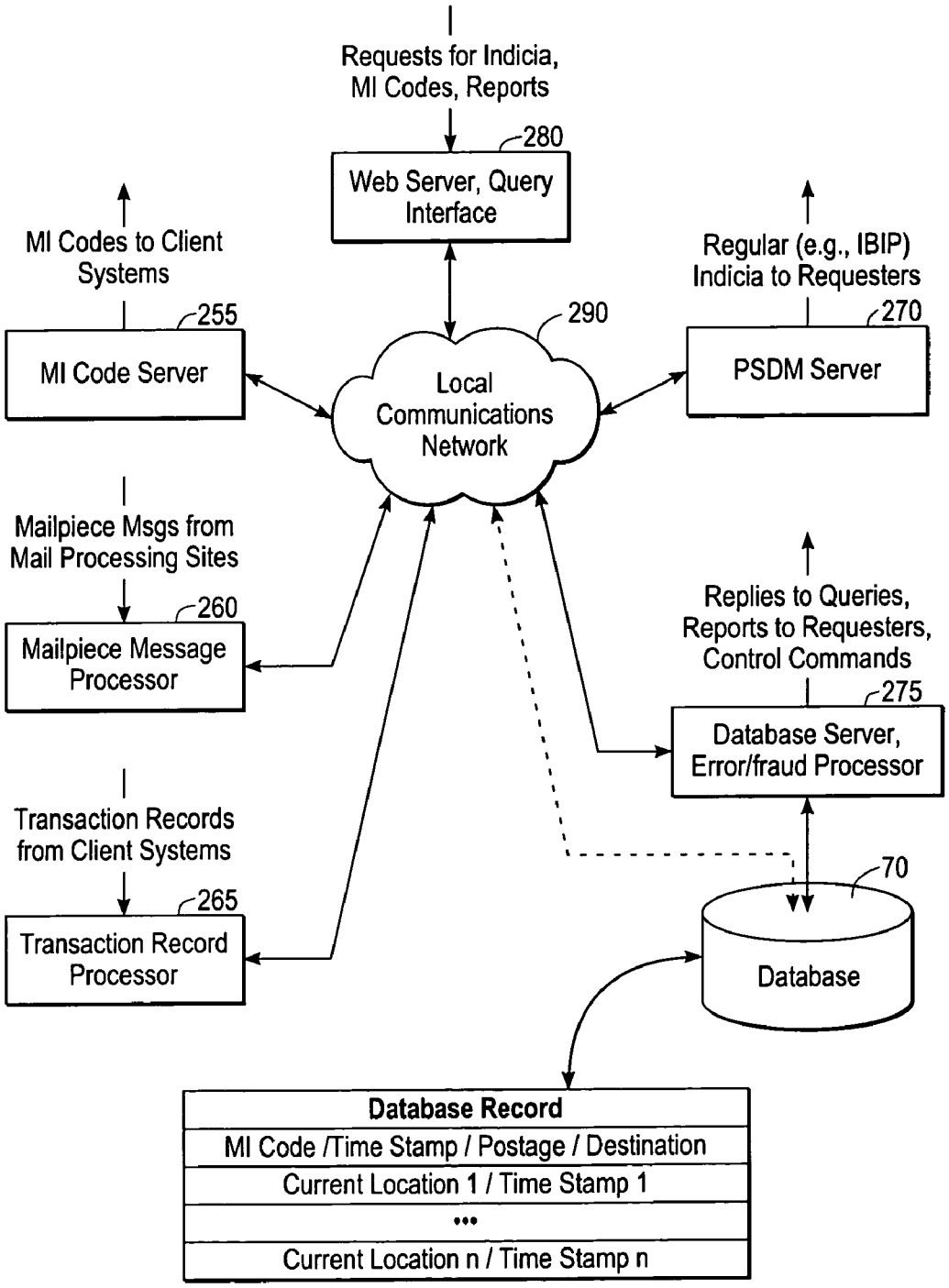
FIG. 7 is a block diagram of an exemplary hardware configuration of a postage vendor system (PVS) suitable for use with embodiments of the invention.

FIG. 7 is an expanded block diagram of PVS 15 suitable for use with embodiments of the present invention. The illustrated architecture is but one example of implementing the functionality described above. The computer systems in the PVS (many of which are explicitly referred to as servers) typically have the same general configuration as the computers in the client systems shown in FIG. 6, with the PVS systems generally having more storage capacity and computing power than the client systems. The diagram is representative in the sense that separate blocks are shown for the various functions that are performed. In fact, multiple functions may be performed by a single hardware computer system on which multiple processes execute, and conversely, some of the processes may be distributed over multiple hardware computer systems. References to a given type of server or processor should be understood to contemplate that there may be more than one of that type of server or processor.

As shown in FIG. 7, PVS 15 may comprise one or more MI code servers 255, one or more mailpiece message processors 260, one or more transaction record processors 265, one or more postal security device module (PSDM) servers 270, one or more database servers 275 connected to database 70, and one or more servers 280 providing web pages and a query interface. The servers and processors are shown as being coupled to a local communications network 290 via a plurality of communication links. Local communications network 290 provides a mechanism for allowing the various components of PVS 15 to communicate and exchange information with each other. While error and fraud processing may be shared among the various entities, such activities typically require access to database 70, and database server 275 is also shown as performing error/fraud processing.

Local communications network 260 may itself comprise many interconnected computer systems and communication links. The communication links may be any mechanisms for communication of information as mentioned above. The various servers are designed to operate in a clustered environment to allow for expandability, and in one implementation, a DCOM (Microsoft's Distributed Component Object Model) interface is used. Each of the servers and processors is shown as having an additional input or output signifying the particular items processed by or provided by that server or processor. Those inputs and outputs are in general connected, one way or another, to communication networks 25 or 35, possibly via local communications network 260. The specific interconnections are not part of the invention so long as a pathway exists.

A number of the functions performed by the PVS may entail cryptographic operations such as generating/verifying digital signatures, hashing, or encrypting/decrypting secure transmissions. To this end, various of the servers and processors may have associated cryptographic modules that perform these functions and store the keys necessary to do so. Depending on the needs, a given server may have one or more dedicated cryptographic modules, may share a pool of one or more cryptographic modules, or may have no need to perform cryptographic operations. In one implementation, an nCipher nFast/CA module, which is validated to FIPS 140-1 Level 3 security, performs the cryptographic tasks that provide secure communications between the client systems and the PVS, while an IBM 4758 PCI cryptographic coprocessor performs the cryptographic IBIP-like tasks such as generating digital signatures for the postal transactions (indicium creation for some embodiments and the audit and postage value download transactions between the PVS and the PSDs in the client systems).

MI Code Server(s)

Each 225 is responsible for generating MI codes for download to client systems such as user computers or kiosks that don't have the capability of generating MI codes themselves. Further, the MI code server is responsible for communicating the MI codes it generates to database server 245 in order to cause a database record to be created for each MI code. Each MI code server may be assigned a unique MIG code by the postage vendor, which MIG code forms a portion of every MI code generated by that MI code server. In some instances, a given MI code server may use multiple MIG codes.

Mailpiece Message Processor(s)

Figures 8A, 8B, 9:
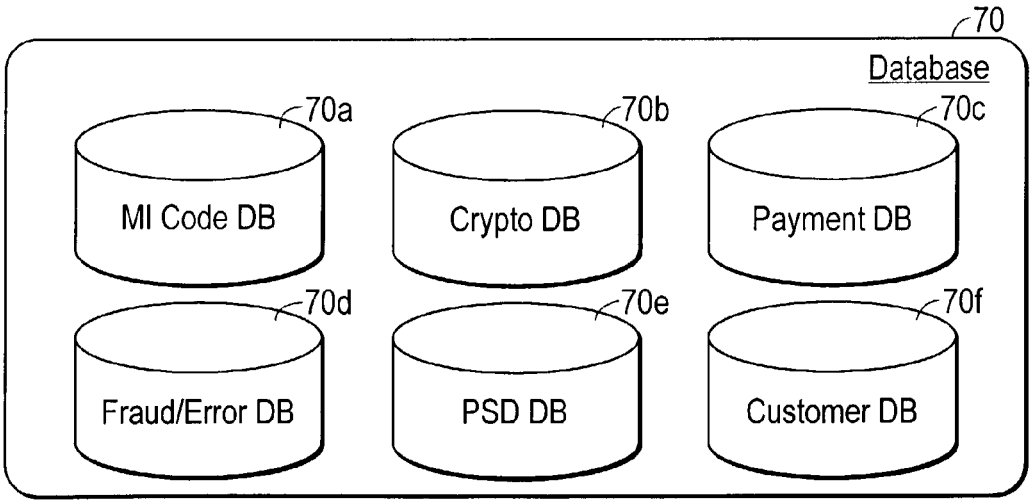
FIG. 8A shows a representative organization of the mailpiece message information sent by a mail processing station to the PVS.
FIG. 8B shows a representative organization of the transaction record information sent by a client system to the PVS.
FIG. 9 shows a representative database organization maintained by the PVS.

FIG. 8A shows a representative organization of the mailpiece message information sent by an MPS to the PVS 15. While conceptually, one could visualize the MPS as sending each message immediately upon scanning the mailpiece and extracting the MI code and other information, a more realistic approach is to accumulate the information from the mailpieces, sort the information by postage vendor, and package the information for each postage vendor into larger data files. These data files, which may be digitally signed by the MPS, may be sent at preset intervals, such as every 4–6 hours, or whenever a sufficient number of mailpiece messages are received. A variant on this is for the individual MPSs to send individual mailpiece messages to a postal service server, perhaps associated with PSS 40, and have the postal service server send batches of mailpiece messages to the different PVSs.

In general, it is preferred to minimize redundant information. For example, while each mailpiece message is considered to include the mailpiece's current location, that information is inherent in the identity of the MPS sending the message, and can be placed in a header that is part of the data file. However, in the event that the MPSs send individual messages to a server, such as a server at PSS 40 or mailpiece message processor 230 at PVS 15, the location of the MPS would have to be included with each message. However, the postal service server could sort the messages by MPS, and send data files where the MPS location was not repeated for each message. As shown in FIG. 8A, each message entry in the file includes the MI code (broken down by MIG code and MI code trailer (this breakdown is not necessary, but may facilitate processing at the PVS). Since all the messages going to a particular PVS would have the same manufacturer ID as part of the MIG codes for the messages, the MIG code could be stripped of the manufacturer ID, but as illustrated, this has not been done.

Each mailpiece message processor 230 is responsible for receiving mailpiece message information from the MPSs, and sending appropriate information to database server 245. As can be seen in FIG. 8A, other information in the mailpiece messages can include the postage, the destination, and a time stamp representing the date and time that the MI code was scanned the particular activities performed by mailpiece message processor 230 may depend on the database organization and the desired division of responsibility between the mailpiece message processor and database server 245. For example, the mailpiece message processor could batch received mailpiece messages, sorted by MIG code, before sending them to the database server.

Transaction Record Processor(s)

FIG. 8B shows a representative organization of the transaction record information sent to PVS 15 by a client device that generates MI codes. As mentioned above, meters and other client systems that generate MI codes are required to send transaction records back to the PVS. Furthermore, even if a client system received a batch of MI codes from the PVS, it is preferred to send transaction records with additional information when the MI code is actually used. As shown in the representative embodiment of FIG. 8B, a batch of transaction records includes the MIG code in the header since it will be the same for all the records generated by that MIG (the latter is subject to the possible caveat that the PVS may have multiple MIG codes).

Each transaction record processor 235 is responsible for receiving mailpiece message information from the MPSs, and sending appropriate information to database server 245. As can be seen in FIG. 8B, other information in the transaction records can include the MIG code trailer, the postage, the destination, and a time stamp representing the date and time that the MI code was generated (or used in the case where the client system got the MI codes from the PVS). The particular activities performed by transaction processor 235 may depend on the database organization and the desired division of responsibility between the transaction record processor and database server 245.

PSDM Server(s)

Each PSDM server 240 is responsible for generating indicia where the postage accounting is done at the time of generating the indicium (these indicia include IBIP-like indicia, with or without digital signatures). As such, PSDM servers are not needed to implement the invention, but it is contemplated that various of the PVS resources for implementing the invention are similar to resources for implementing IBIP-like infrastructures, and can possibly be shared.

In general, functions performed by the PSDM server include functions performed by a postal security device (PSD) as described in the IBIP specifications published by the USPS. For example, functions performed by PSDM servers include initialization and creation of PSD resources, digital signature generation (although not for indicia in accordance with some embodiments of the present invention), management of funds related to the postage dispensed by PVS 15, generation of information for printing the indicia, key handling, and other functions.

Each PSDM server 240 uses PSD resources to generate information for printing indicia and to track monetary amounts related to the postage dispensed by PVS 15. A PSD resource is a software construct that has attributes of a PSD, including a unique PSD identifier (e.g., a four-byte identifier), a DR value (e.g., a four-byte value), an AR value (e.g., a five-byte value), and a control code (e.g., a 20-byte value). The PSD identifier uniquely identifies each PSD resource, the AR value represents the total monetary value of all indicia ever produced by the PSD resource during its life cycle, and the DR value indicates the available funds assigned to the PSD resource which may be used to dispense postage. The control code is a secure hash of the AR and DR values. By using a plurality of PSD resources, multiple PSDM servers can run concurrently, producing indicia in parallel without the bottleneck of sharing a single PSD resource. Each PSD resource may be assigned a unique serial number by the postage vendor.

Web Server(s)

Web server(s) 250 may host the postage vendor's web site and store web pages provided by the postage vendor. Web server 250 is responsible for receiving URL requests from requesting entities (e.g., kiosks and other user computers on the network), and for forwarding web pages corresponding to the URL requests to the requesting entity. These web pages allow a user to interact with PVS 15, e.g., to configure a request to purchase MI codes (or postage) from PVS 15. When the requesting entity requests communication with PVS 15, the web server may be configured to establish a communication link between the requesting entity and the PVS. For example, web server 250 may establish a secure Internet socket link. e.g., a SSL 2.0 link, between the PVS and the requesting entity, and may also be configured to control the downloading of printer control programs from the PVS to the requesting entities. The web server may also provide a query interface for mailers (or others, such as recipients of reply inserts described above) to track mailpieces and for mailers to request reports. In some implementations, reports are automatically e-mailed to mailers.

Database Server(s) and Database-Related Issues

Database 70 acts as a repository for storing information related to the process of MI code generation, tracking, and accounting. Database server 275 is drawn as a single block and represents one or more processing elements that manipulate the information stored in database 70 (also drawn as a single element). It should be recognized that the database storage may be distributed and that access may be over local communications network 290 or another mechanism (not specifically shown). A dashed connection to local communications network 290 is shown, signifying that there may be some database transactions that could be carried out by other elements on the network without participation by database server 275. In one implementation, an ODBC interface is used. A schematic view of a database record is shown, representing static information (MI code, postage, time stamp, and destination) as well as location updates based on mailpiece messages from the MPSs.

References to database 70 in the above discussion treated the database as having a record for each MI code, with the database record being created at one of three times:

- The PVS generates the MI code and sends it to the mailer;
- The mailer generates the MI code and sends the PVS a transaction record for the MI code before the MI code appears in a mailpiece message; or
- The MI code appears in a mailpiece message before the mailer has sent the transaction record for the MI code to the PVS.

In the first two situations, the database record for the MI code is described as being updated in response to each received mailpiece message that includes the MI code. In the third situation, the database record for the MI code is described as being updated in response to each subsequent received mailpiece message that includes the MI code, and in response to receiving the transaction record for the MI code.

This is a conceptually correct view of the PVS's information concerning the MI code, but it may differ from the actual manner in which the information is stored. There are many well known ways to organize databases, including relational databases, flat-file databases (possibly with repeating fields) and object-oriented databases. Aspects of the invention are not limited to any particular way in which the database is organized. Rather, what is relevant is that the PVS be able to:

- In response to a mailpiece message including a particular MI code, gather other information about that MI code from previous mailpiece messages (if any) and from the transaction record for that MI code (if present);
- In response to queries specifying a particular MI code, provide at least tracking information for that MI code (e.g., location(s) of the MPS(s) that sent mailpiece message(s), or perhaps only the location of the last MPS that sent a mailpiece message); and
- In response to queries specifying a MIG code and other parameters, provide a report specifying at least some of the information in the database for at least some of the MI codes associated with that MIG code.

Database server 275 is responsible for maintaining database 70, which entails creating database records, updating database records, responding to queries and generating reports based on the database records. As alluded to above, the database server is a likely candidate for performing the error and fraud detection activities described above.

FIG. 9 shows schematically how database 70 can encompass a number of separate databases to support the operation of the invention as well as more traditional postage vending (e.g., IBIP-like functions). In particular, an MI code database **70*a* stores the records that have been discussed at length above in connection with embodiments of the invention, and therefore generally represents database 70** in relation to the invention. The nature of the information stored in this database has been discussed at length above. The other databases support some of the ancillary operations, and will only be mentioned briefly. It should be understood, however, that the particular partitioning of the databases can be varied, augmented, or diminished depending on the specific environment and the range of functionality required.

A cryptographic database **70*b*** stores cryptographic information such as X.509 certificate serial numbers or even the actual certificates themselves. These are needed for verifying digital signatures for transactions requiring such verification. This could include digitally signed transaction record files or mailpiece message files in support of the invention. Additional transactions could include the IBIP audit and postal value download request messages, which are not part of the present invention. The actual verification of the digital signatures would be performed by one of the cryptographic modules.

A payment database **70*c* stores encrypted credit card information and payment information, but normally not accounting information. A fraud/error database 70*d* stores information supporting the fraud and error detection activities discussed above. This could include routing maps to detect mailpieces that are apparently in the wrong place, statistical patterns regarding normal and fraudulent mailpiece activities, and records for suspect mailpieces. A PSD database 70***e* stores information relating to dispensing of regular (e.g., IBIP-like) postage. This might include information related to the PSD resources and other information (log files of indicium transaction records) required to be maintained by an IBIP host. PSD database 70*e* may also store the postal license number assigned to PVS 15 by the postal service. A customer database 70*f* is shown and can store information regarding customers, especially information about all the MIGs. This information would support activities such as billing and sending reports to the mailers.

CONCLUSION

While the above is a complete description of specific embodiments of the invention, various modifications, alternative constructions, and equivalents may be used. Therefore, the above description should not be taken as limiting the scope of the invention as defined by the claims.

What is claimed is:

1. A method of tracking and accounting for a mailpiece, the mailpiece being associated with a first postage amount, the first postage amount equal to a sum of a first installment and a second installment, the method comprising:

generating a unique mailpiece identification (MI) code;

debiting a mailer account associated with a mailer by a first installment;

applying the MI code to a mailpiece, the MI code uniquely identifying the mailpiece;

at a mail processing site associated with a carrier, receiving the mailpiece from the mailer;

scanning the mailpiece to obtain the MI code and a destination code, the destination code signifying at least part of an address associated with a destination related to a recipient, and sending a mailpiece message from the mail processing site to a postage vendor site associated with a postage vendor, the mailpiece message including at least information associated with the MI code, the destination code, and a current location;

at the postage vendor site, receiving the mailpiece message from the mail processing site, determining the mailer account based on at least information associated with the mailpiece message, determining whether the mailpiece message is the first communication for the MI code to the postage vendor site, and if the mailpiece message is the first communication for the MI code, debiting the mailer account associated with the mailer by a second installment, a sum of the first installment and the second installment being equal to a first postage amount; and crediting a carrier account associated with the carrier by a second postage amount;

wherein the mailer is different from the recipient and the postage vendor; and the postage vendor is different from the recipient and the carrier.

2. The method of claim 1 wherein the first postage amount and the second postage amount are equal.

3. The method of claim 1, and further comprising:

storing information associated with the MI code, the current location, the destination code, the first postage amount, the second postage amount, and the mailer account, the postage amount being associated with the mailpiece.

4. The method of claim 1, and further comprising:

determining whether the current location corresponds to the destination; and if the current location corresponds to the destination, designating the MI code as no longer valid.

5. The method of claim 1, and further comprising:

if the mail processing site is the last mail processing site, designating the MI code as a retired MI code in response to receiving the mailpiece message from the mail processing site.

6. The method of claim 1 wherein the MI code is applied in human-readable form and machine-readable form.

7. The method of claim 1, and further comprising:

determining the destination associated with the mailpiece based on at least information associated with the destination code;

wherein the mailpiece message includes at least the destination.

8. The method of claim 1, and further comprising:

the applying the MI code to mailpiece is performed prior to the receiving the mailpiece from the mailer at a mail processing site.

9. The method of claim 1 wherein the determining the mailer account comprises associating the MI code with the mailer.

10. The method of claim 1, and further comprising:

creating a database record that corresponds to the MI code;

storing at least the current location, the destination, and the first postage amount in the database record that corresponds to the MI code.

11. The method of claim 1, and further comprising:

determining whether the MI code is a valid MI code after the receiving the mailpiece message from the mail processing site the postage vendor site.

12. The method of claim 1 wherein the first postage amount and the second postage amount are different.

13. The method of claim 1, and further comprising:

determining the first postage amount associated with the mail piece.

14. The method of claim 13 wherein:

determining the first postage amount comprises rating the mailpiece at the mail processing site; and the mailpiece message from the mail processing site includes the first postage amount.

15. The method of claim 1, and further comprising:

generating the MI code at a mailer site remote from the postage vendor site, the mailer site being associated with the mailer.

16. The method of claim 15 wherein the generating the MI code at a mailer site is performed under the authority of the postage vendor.

17. The method of claim 15, and further comprising:

creating a database record corresponding to the MI code after the receiving the mailpiece message from the mail processing site at the postage vendor site.

18. The method of claim 1, and further comprising:

generating the MI code at the postage vendor site associated with the postage vendor.

19. The method of claim 1, and further comprising:

storing information representative of the MI code, prior to the applying the MI code to a mailpiece.

20. The method of claim 18 wherein the applying the MI code to a mailpiece comprises:

sending the MI code to a mailer site; and applying the MI code to the mailpiece at the mailer site.

21. The method of claim 18, and further comprising:

communicating the MI code to a mailer site that is associated with the mailer and is remote from the postage vendor site.

22. A method of tracking and accounting for a mailpiece, the method comprising:

receiving a mailpiece from a mailer at a mail processing site associated with a carrier;

scanning the mailpiece to obtain a mailpiece identification (MI) code and a destination code, the MI code uniquely identifying the mailpiece, the destination code signifying at least part of an address associated with a destination related to a recipient;

sending a mailpiece message from the mail processing site to a postage vendor site associated with a postage vendor, the mailpiece message including at least information associated with the MI code, the destination code, and a current location;

receiving the mailpiece message from the mail processing site by the postage vendor site associated with the postage vendor;

determining a mailer account based on at least information associated with the mailpiece message, the mailer account being associated with the mailer;

determining whether the mailpiece message is the first communication for the MI code to the postage vendor site; and if the mailpiece message is the first communication for the MI code, debiting the mailer account associated with the mailer by a first amount;

crediting a carrier account associated with the carrier by a second amount;

wherein the mailer is different from the recipient;

the mailer is different from the postage vendor;

the recipient is different from the postage vendor; and the postage vendor is different from the carrier;

generating the MI code at the postage vendor site associated with the postage vendor;

determining a third amount at the postage vendor site;

debiting the mailer account associated with the mailer by a third amount; and after the debiting the mailer account by a third amount, sending the MI code from the postage vendor site to a mailer site, the mailer site associated with the mailer and remote from the postage vendor site.

23. A method of tracking and accounting for a mailpiece, the method comprising:

receiving a mailpiece from a mailer at a mail processing site associated with a carrier;

scanning the mailpiece to obtain a mailpiece identification (MI) code and a destination code, the MI code uniquely identifying the mailpiece, the destination code signifying at least part of an address associated with a destination related to a recipient;

sending a mailpiece message from the mail processing site to a postage vendor site associated with a postage vendor, the mailpiece message including at least information associated with the MI code, the destination code, and a current location;

receiving the mailpiece message from the mail processing site by the postage vendor site associated with the postage vendor;

determining a mailer account based on at least information associated with the mailpiece message, the mailer account being associated with the mailer;

determining whether the mailpiece message is the first communication for the MI code to the postage vendor site; and if the mailpiece message is the first communication for the MI code, debiting the mailer account associated with the mailer by a first amount;

and crediting a carrier account associated with the carrier by a second amount;

wherein the mailer is different from the recipient and the postage vendor;

the postage vendor is different from the recipient and the carrier; and the first amount and the second amount are different.

* * * * *